US008932102B2

(12) United States Patent
Wong

(10) Patent No.: US 8,932,102 B2
(45) Date of Patent: Jan. 13, 2015

(54) STEERING MECHANISM FOR TOY VEHICLE

(75) Inventor: Kwok Leung Wong, Causeway Bay (HK)

(73) Assignee: Silverlit Limited, Causeway Bay (HK)

( * ) Notice: Subject to any disclaimer, the term of this patent is extended or adjusted under 35 U.S.C. 154(b) by 561 days.

(21) Appl. No.: 13/301,418

(22) Filed: Nov. 21, 2011

(65) Prior Publication Data

US 2013/0130588 A1 May 23, 2013

(51) Int. Cl.
*A63H 17/36* (2006.01)
*A63H 17/395* (2006.01)

(52) U.S. Cl.
CPC ..... *A63H 17/395* (2013.01)
USPC ..... 446/468; 446/129; 446/460

(58) Field of Classification Search
USPC ..... 446/129, 130, 131, 133–136, 433, 441, 446/444, 454–457, 460, 465, 468, 469
See application file for complete search history.

(56) References Cited

U.S. PATENT DOCUMENTS

| | | | | |
|---|---|---|---|---|
| 3,246,719 | A | 4/1966 | Lahr | |
| 4,571,213 | A * | 2/1986 | Ishimoto | 446/468 |
| 4,881,917 | A | 11/1989 | Suzuki et al. | |
| 5,449,311 | A | 9/1995 | Williams | |
| 5,851,134 | A | 12/1998 | Chiu | |
| 6,350,173 | B1 * | 2/2002 | Tsang | 446/444 |
| 7,666,055 | B2 * | 2/2010 | Kim | 446/136 |
| 7,938,709 | B2 * | 5/2011 | Leonov | 446/468 |
| 8,231,427 | B2 * | 7/2012 | Wong et al. | 446/468 |
| 8,337,274 | B1 * | 12/2012 | Wong | 446/454 |
| 2003/0143921 | A1 | 7/2003 | Yoneda | |
| 2005/0250413 | A1 * | 11/2005 | Lo et al. | 446/427 |
| 2009/0247044 | A1 | 10/2009 | Wong et al. | |
| 2009/0325460 | A1 * | 12/2009 | Leonov | 446/468 |

FOREIGN PATENT DOCUMENTS

| | | | |
|---|---|---|---|
| EP | 0 141 945 | A2 | 5/1985 |
| WO | WO 02/085479 | A1 | 10/2002 |

OTHER PUBLICATIONS

European Search Report for European Patent Application No. EP12191426.1, completed on Sep. 29, 2014 in Munich.

* cited by examiner

*Primary Examiner* — Nini Legesse
(74) *Attorney, Agent, or Firm* — Greenberg Traurig, LLP

(57) ABSTRACT

A movable toy vehicle comprises a vehicle body, chassis, and power source with at least one battery. A magnetic coil activator and a magnet for wheel steering control affects steering. A circuit applies a current to the coil thereby to move the magnet. Movement of the magnet is transmitted to a steering shaft thereby permitting steering the vehicle. The magnet is a permanent magnet, and includes a mounting to pivot the permanent magnet in relation to a coil, and wherein the coil is powered by the battery. The toy car can be remote controlled.

22 Claims, 14 Drawing Sheets

STEERING MECHANISM FOR TOY VEHICLE

FIELD OF THE DISCLOSURE

The present disclosure relates generally to toy vehicles and, more particularly, to remote control toy vehicles.

BACKGROUND

Steering mechanism for toy vehicles have been known for many years. Examples are disclosed in U.S. Pat. Nos. 5,851,134 and 4,881,917.

A variety of toy vehicles such as toy car are known. Like a real car, the remote control toy cars are usually designed to achieve effective steering with reliability. A toy vehicle design having a system to regulate steering would be desirable and provide enhanced entertainment value.

SUMMARY

The present disclosure provides a toy so as to provide amusement to the user.

In present disclosure, the steering mechanism in one form uses a single permanent magnet and single coil system.

According to one aspect of the disclosure, a toy vehicle is provided wherein there is a vehicle body, chassis, power source with at least one battery, electronic circuit board for motor speed control, and receiving remote signal from transmitter.

There is a magnetic coil activator for wheel steering control. To provide for effective steering there is provided a permanent magnet pivoted in relation to a coil which is powered by the battery. Applying a current to the coil moves the magnet, and through the magnet, movement is transmitted to a steering shaft thereby steering of the vehicle is affected.

There is at least one electric motor for driving a wheel of the vehicle, and there can be a gear box associated with a wheel and the electric motor for power transmission.

When the operator of the vehicle desires to have the vehicle to turn, the remote controller is activated and signals a microcontroller inside the vehicle, the microcontroller responds to the signal and applies the energy to the coil for affecting steering of the wheels.

The disclosure is further described with reference to the accompanying drawings.

BRIEF DESCRIPTION OF THE DRAWINGS

The novel features of this disclosure, as well as the disclosure itself, both as to its structure and its operation, will be best understood from the accompanying drawings, taken in conjunction with the accompanying description, in which similar reference characters refer to similar parts, and in which:

FIG. 3*b* and FIG. 3*c* shows the magnet deflection after energizing.

FIGS. 11*a*, 11*b* and 11*c* show the front wheel suspension system of a toy vehicle, wherein FIG. 11*a* is for level travel, FIG. 11*b* is a tilt to the right and FIG. 11*c* is a tilt to the left.

DETAILED DESCRIPTION

Figure 2:
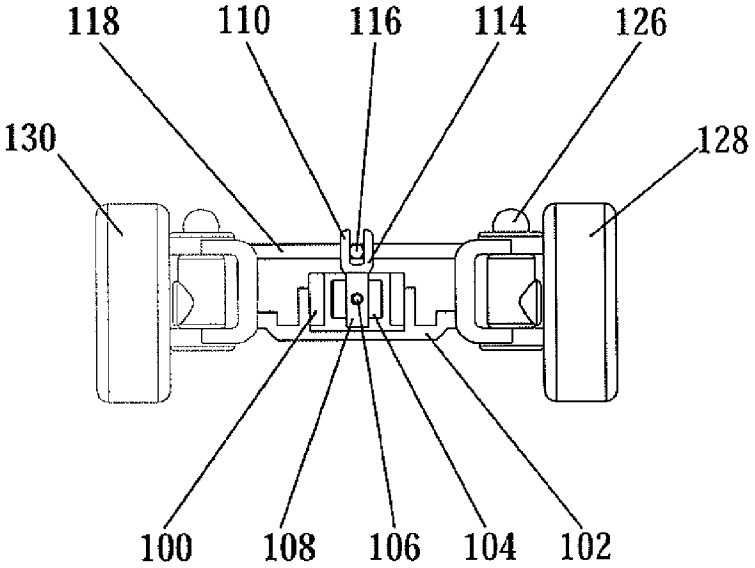
FIG. 2 shows the front view of a toy vehicle.

Certain terminology is used in the following description for convenience only and is not limiting. The word "a" is defined to mean "at least one." The terminology includes the words above specifically mentioned, derivatives thereof and words of similar import. In the drawings, like numerals are used to indicate like elements throughout.

Figure 1:
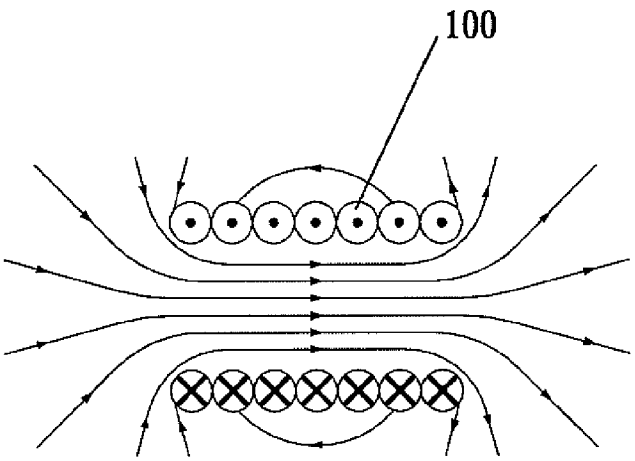
FIG. 1 shows the electromagnetic field of solenoid.
Figure 3C:
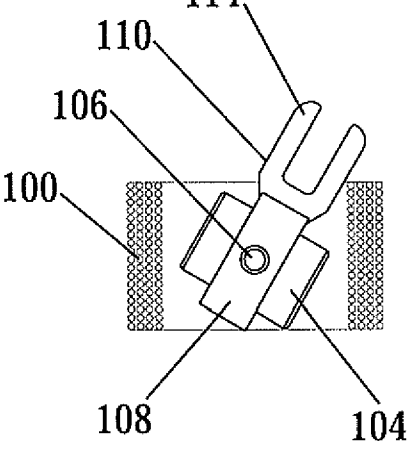
FIG. 3*c* shows the lever is deflected to opposite position.
Figure 3B:
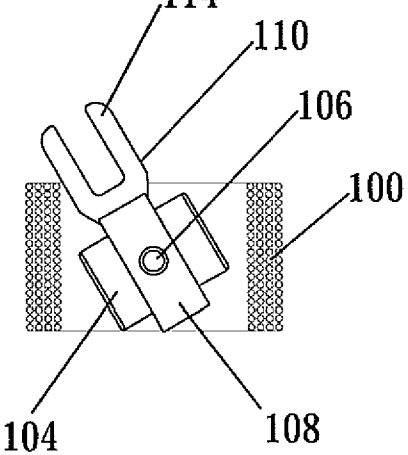
FIG. 3*b* shows the lever deflected to one position.
Figure 3A:
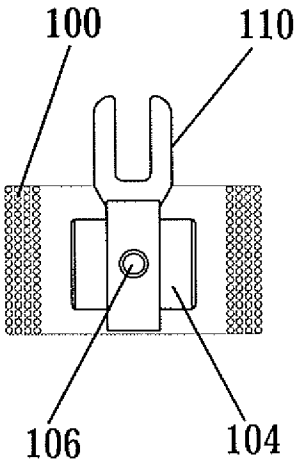
FIG. 3*a* shows the cross-section of a coil and a lever located at central position.

Most people desire to have a responsive and efficient steering for the toy car. As shown in FIG. 1, for a solenoid coil, the electromagnetic field strength is the strongest inside the coil. To achieve a high performance, a magnet is put inside the coil. When the solenoid is energized, it generates sufficient electromagnetic force to deflect the magnet. This force is further transferred to linear motion through a lever and a slide plate. This is the use of an electromechanical actuator for driving the steering mechanism.

A movable toy vehicle comprises a vehicle body, chassis, a front wheel and a rear wheel, and a power source with at least one battery.

There is a magnetic coil activator and a magnet for wheel steering control, a circuit for applying a current to the coil thereby to move the magnet. Movement of the magnet is transmitted to a steering shaft thereby permitting steering the vehicle.

The magnet can be a permanent magnet, and there is a mounting to pivot the permanent magnet in relation to a coil, and wherein the coil is powered by the battery.

An electronic circuit board is provided for motor speed control, and for receiving remote signal from transmitter and a remote control device. The remote control has controls for a user to regulate the movement of the vehicle. There is at least one drive electric motor for driving a wheel of the vehicle, and a receiver with the vehicle for receiving a signal from a transmitter with the remote controller.

A mounting for the coil on the vehicle chassis is provided, and the permanent magnet is attached to one end of a lever. The magnet is located inside the coil and is pivotable transversely on the coil axis so that when the coil is energized by electric current, the magnetic field generated from the coil deflects the permanent magnet and the lever to one side.

The other end of the lever as a fork, and including a rod for engagement with the fork. The rod is connected with of a slide plate, the plate being slidable relative to a frame. When the lever is deflected by electromagnetic force, a plane movement of the slide plate is effected transversely of a longitudinal axis of the vehicle.

Each respective end of the slide plate are connected to a mechanical linkage respectively of a left front wheel and a right front wheel for the vehicle. When the slide plate performs a linear plane movement, the linear motion is transformed to a turning effect of front wheels of a vehicle.

There is a spring, the spring being for urging the return the slide plate and the lever to a neutral position, the neutral position being when the coil is dis-energized.

The other end of the lever as a ball joint, and including a rod for engagement with the ball joint.

The coil can be mounted relative to the chassis whereby the orientation of coil and magnet is so that there is a vertical alignment of the coil. Alternatively, the coil is mounted relative to the chassis whereby the orientation of the coil and magnet is so that there is a horizontal alignment of the coil.

There can be a pair of slide plate that perform a linear plane movement, the linear motion being transformed to a turning effect of front wheels of a vehicle. The first slide plate can be mounted in front of a wheel axis and a second slide plate can be mounted behind the wheel axis.

There can be a front wheel suspension system and a hinge relative to on the chassis. In this manner the chassis and an axle between the front wheels are relatively movable and pivotable around a longitudinal axis of the vehicle.

Figure 4:
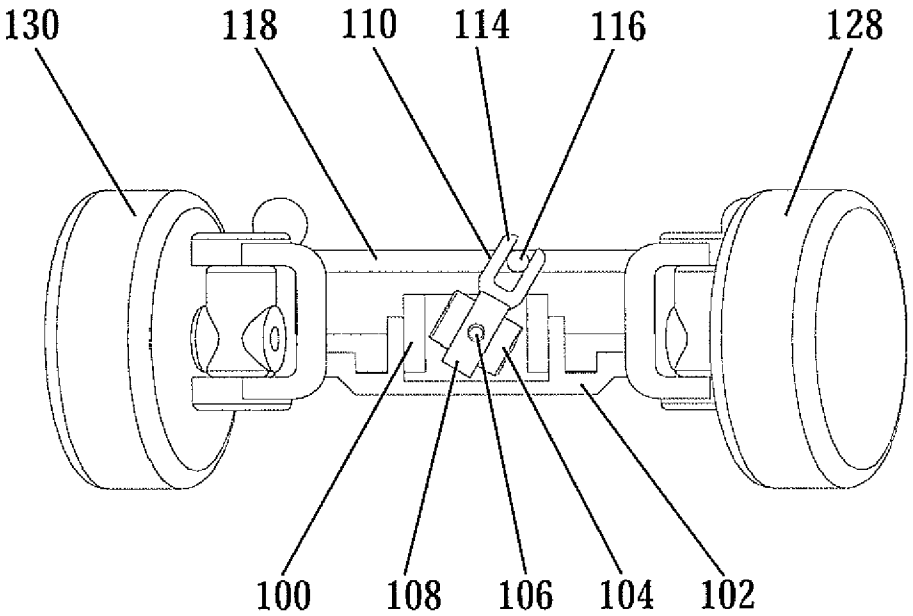
FIG. 4 shows the car wheels turn right while the lever is deflected to opposite position.
Figure 5A:
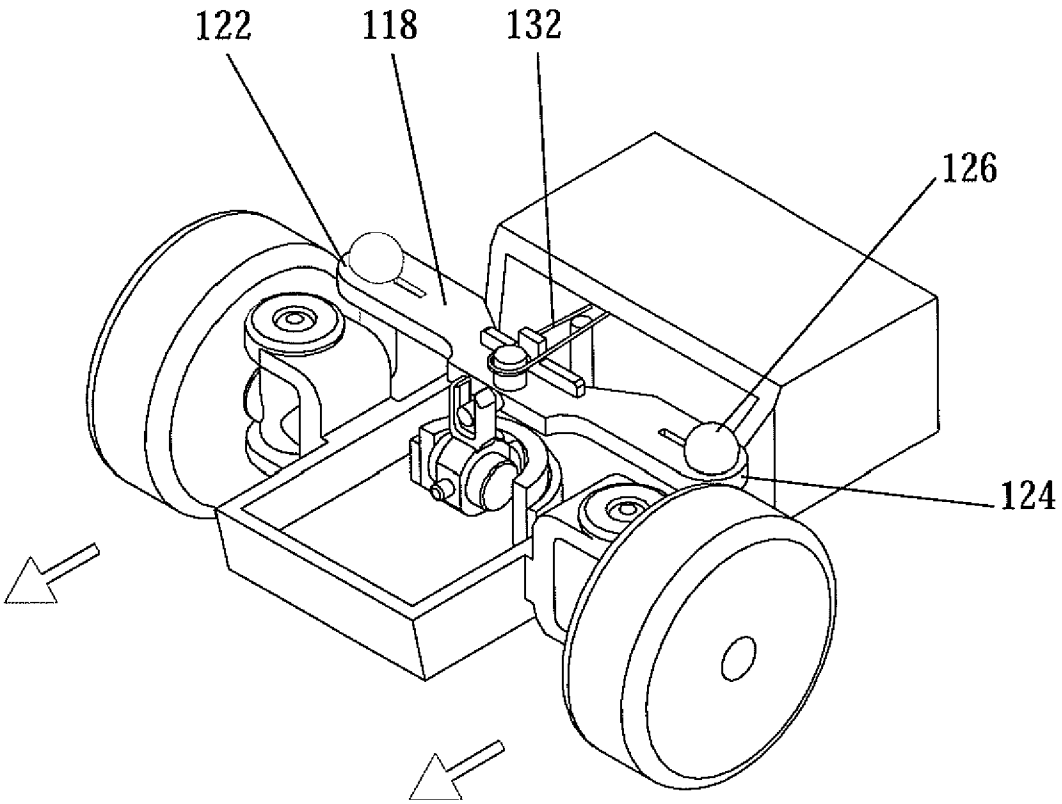
FIG. 5*a* shows in isometric view a slide plate in a neutral straight position relative to the longitudinal axis of a vehicle.
Figure 5B:
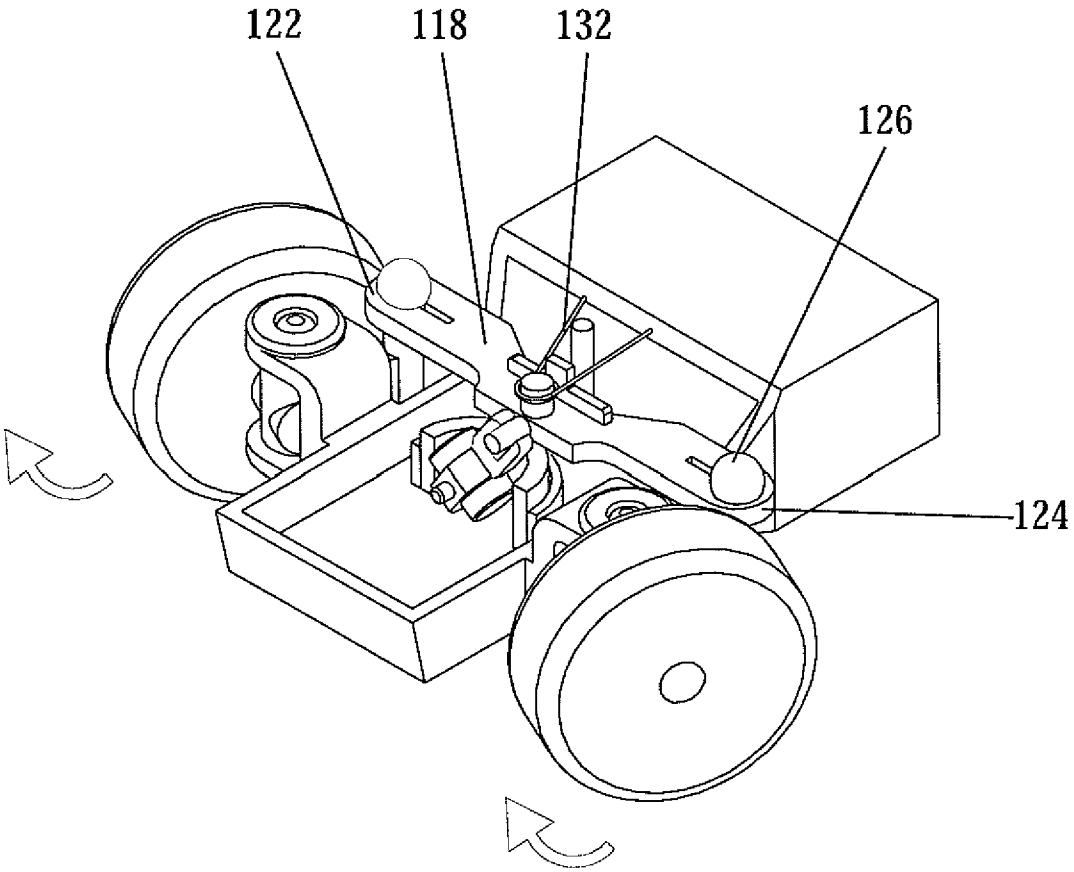
FIG. 5*b* shows in isometric view a slide plate moved transversely of longitudinal axis to affect a right turn.
Figure 5C:
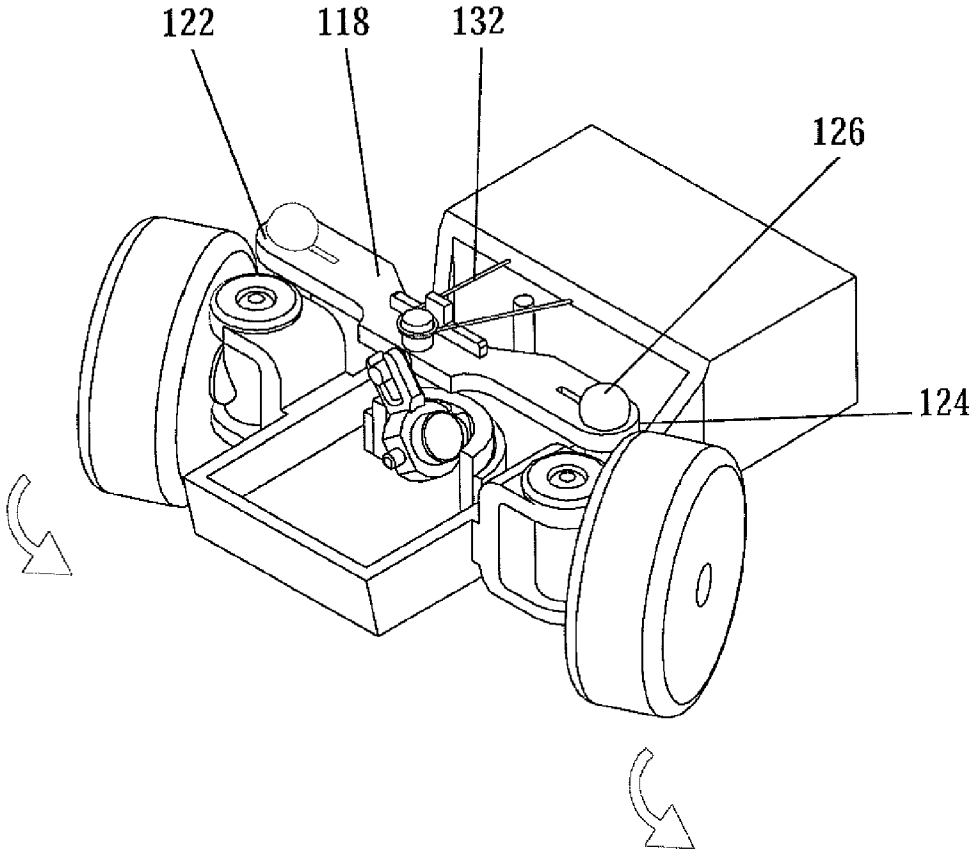
FIG. 5*c* shows in isometric view a slide plate moved transversely of longitudinal axis to affect a left turn.

The steering mechanism of the disclosure comprises:

1. A solenoid coil 100 mounted on a car chassis 102. (FIG. 2)
2. A permanent magnet 104 is attached at pivot 106 towards one end 108 of a lever 110. The magnet 104 is located inside the coil 100 and pivoted transversely on the coil axis 112 so that when the coil is energized by electric current, the magnetic field generated from the coil deflects the permanent magnet and hence the lever to one side. Similarly, when the coil is energized by opposite current, the lever will be deflected to the other side. (FIGS. 3*a* to 3*c* and FIG. 4)
3. The other end of the lever 110 is a fork design 114. This fork 114 is plugged into a small rod 116 mounted on a slide plate 118. This plate 118 can slide on top of a frame. Once the lever is deflected by electromagnetic force, it induces a plane linear movement of the slide plate transversely of the car longitudinal axis 120. (FIG. 4)
4. Both ends 122 and 124 of the slide plate are further connected to the mechanical linkages 126 of a left and a right front wheel 128 and 130 respectively. When the slide plate performs plane movement, the linear motion force transforms this to the turning effect of front wheels. (FIGS. 5*b* and 5*c*)
5. A spring 132 is used to return the slide plate and hence lever to neutral position when the coil is dis-energized. (FIG. 5*a*)

Some other alternative embodiments of the disclosure are illustrated.

Figure 7:
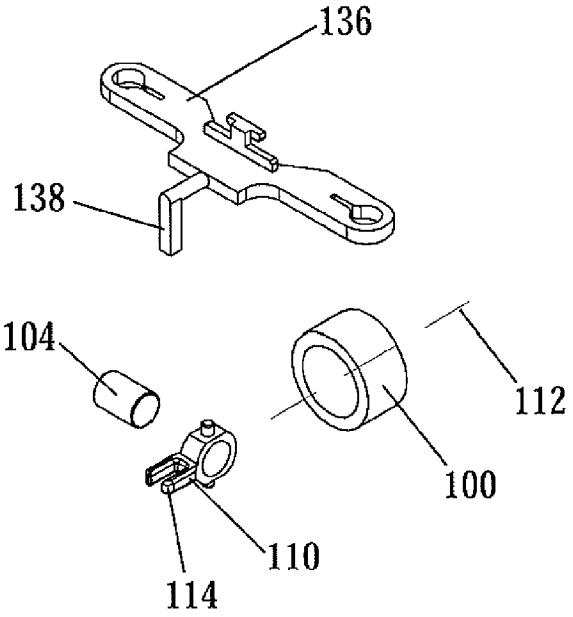
FIG. 7 is an exploded view of an alternative second slide plate design for a different coil orientation.
Figure 6:
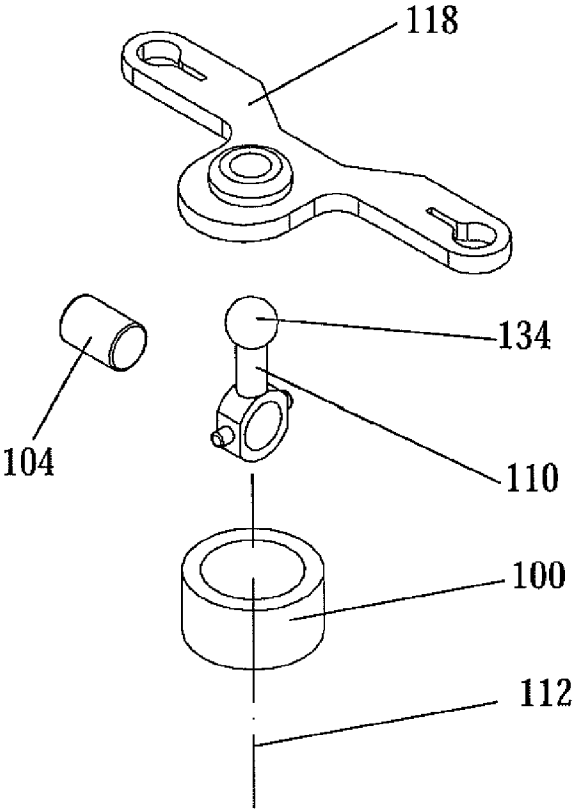
FIG. 6 is an exploded view with ball joint design on a lever.
Figure 8A:
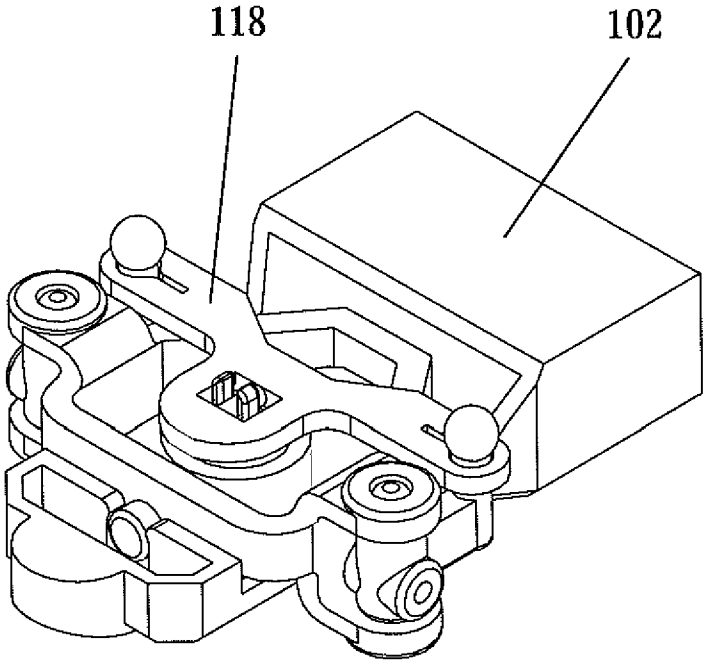
FIG. 8*a* is an isometric view of car chassis where the slide plate is behind the wheel axis.
Figure 8B:
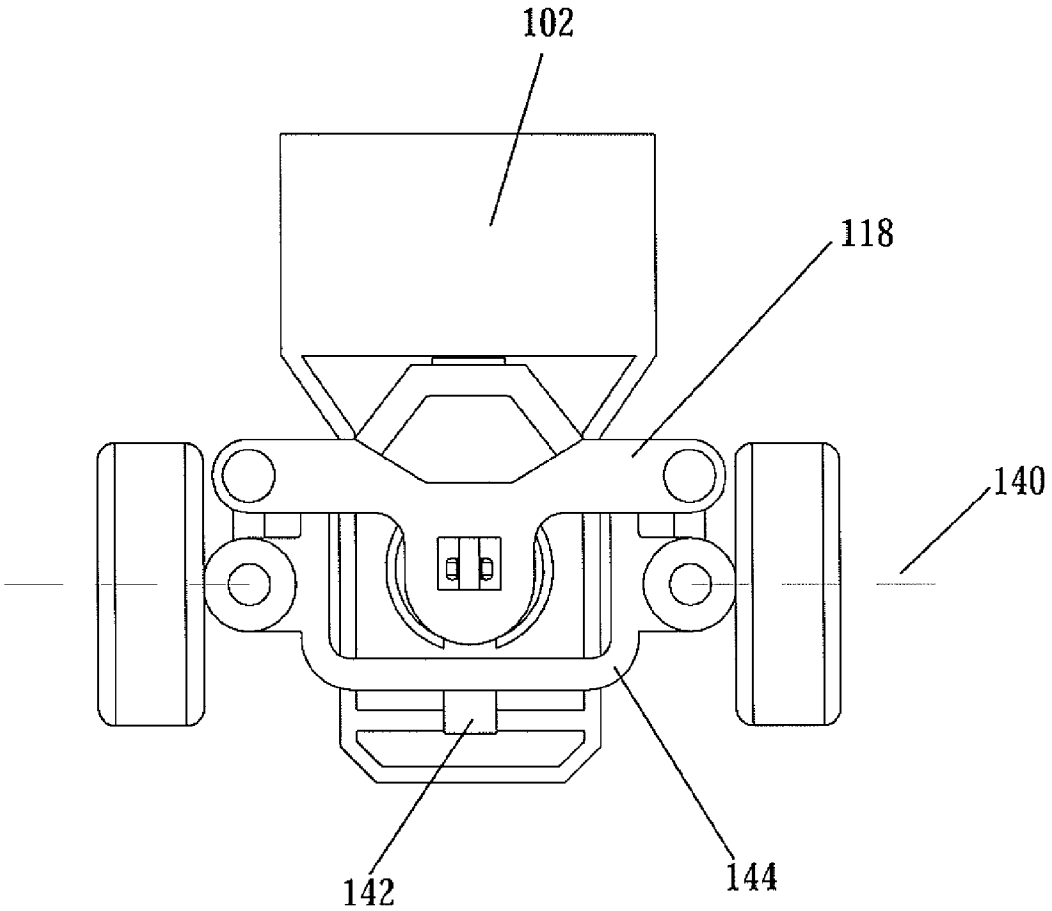
FIGS. 8*b* and 9*b* are the top view of FIGS. 8*a* and 9*a* respectively.
Figure 9A:
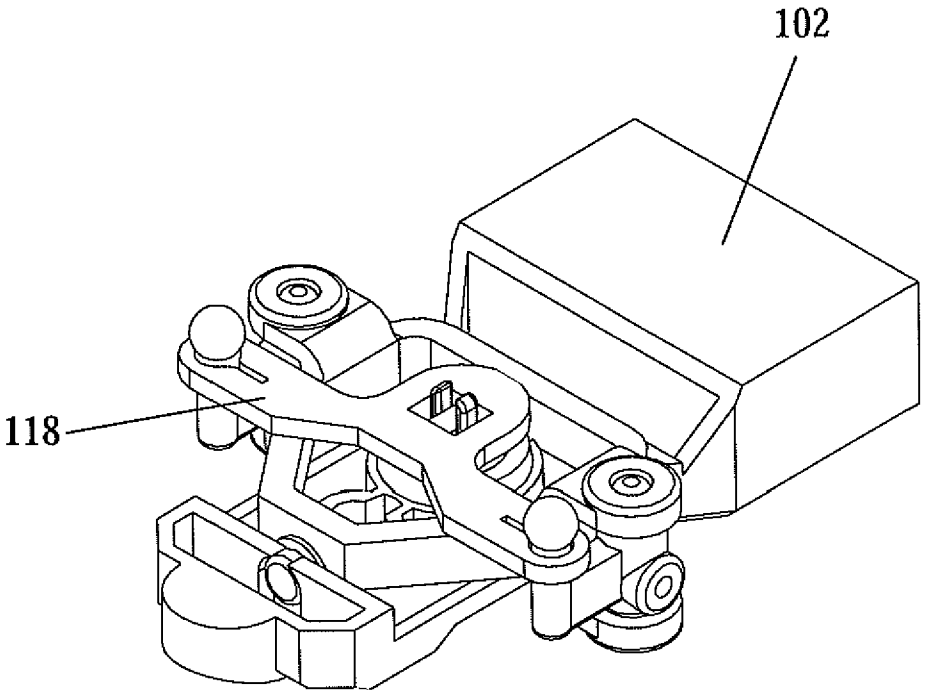
FIG. 9*a* is an isometric view of car chassis where the slide plate is in front of wheel axis.
Figure 9B:
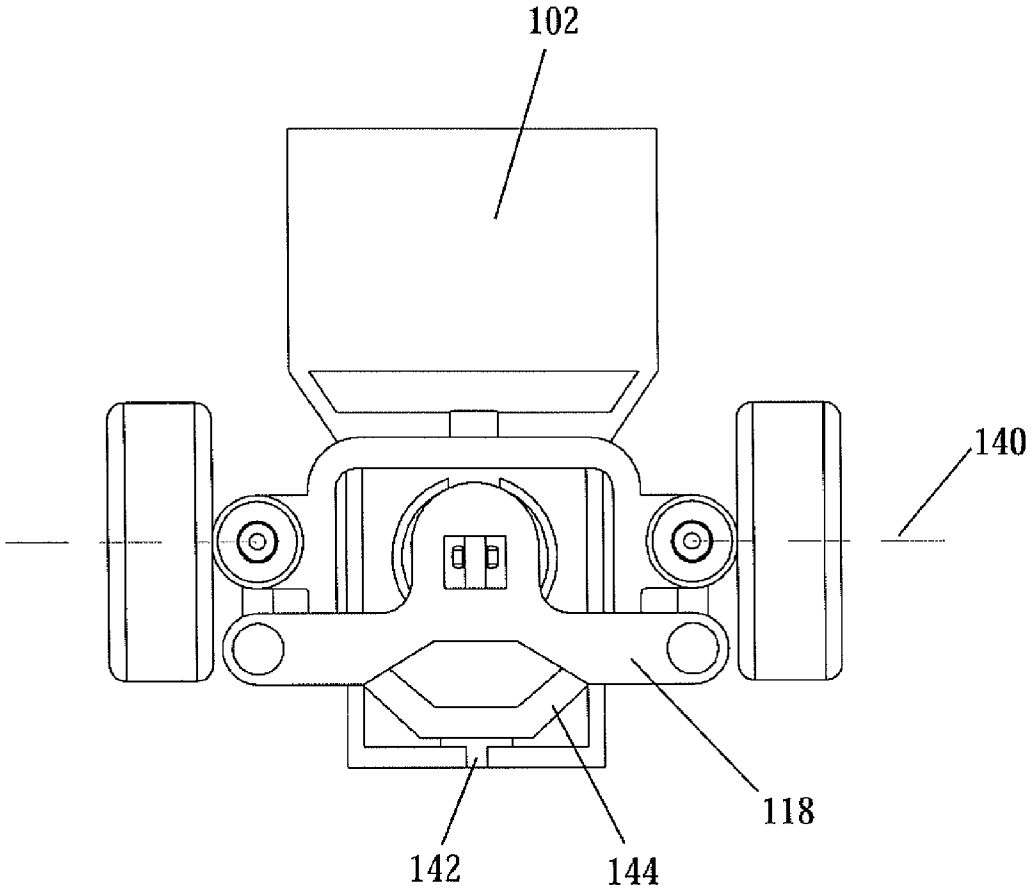
Figure 10:
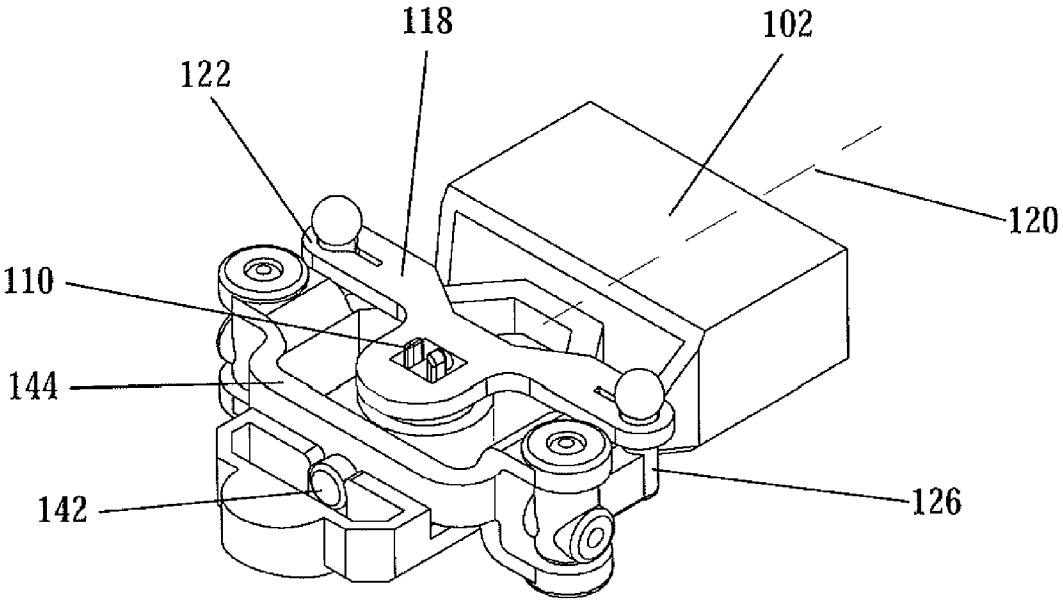
FIG. 10 is an isometric view of part of the chassis of a toy vehicle.
Figure 11C:
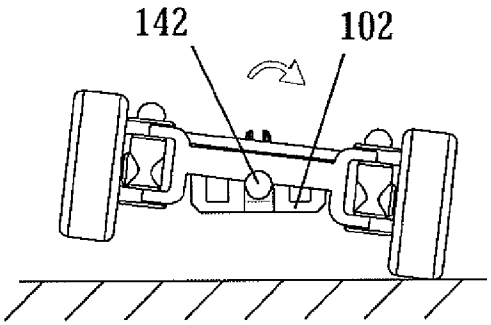
Figure 11B:
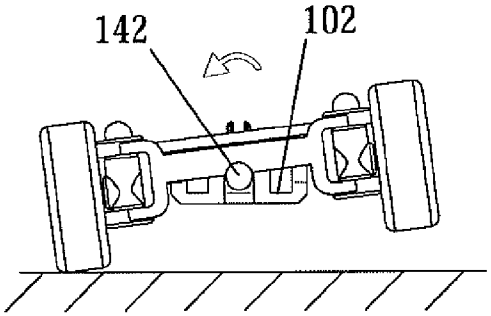
Figure 11A:
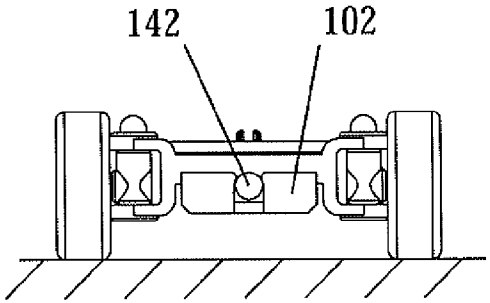
Figure 12:
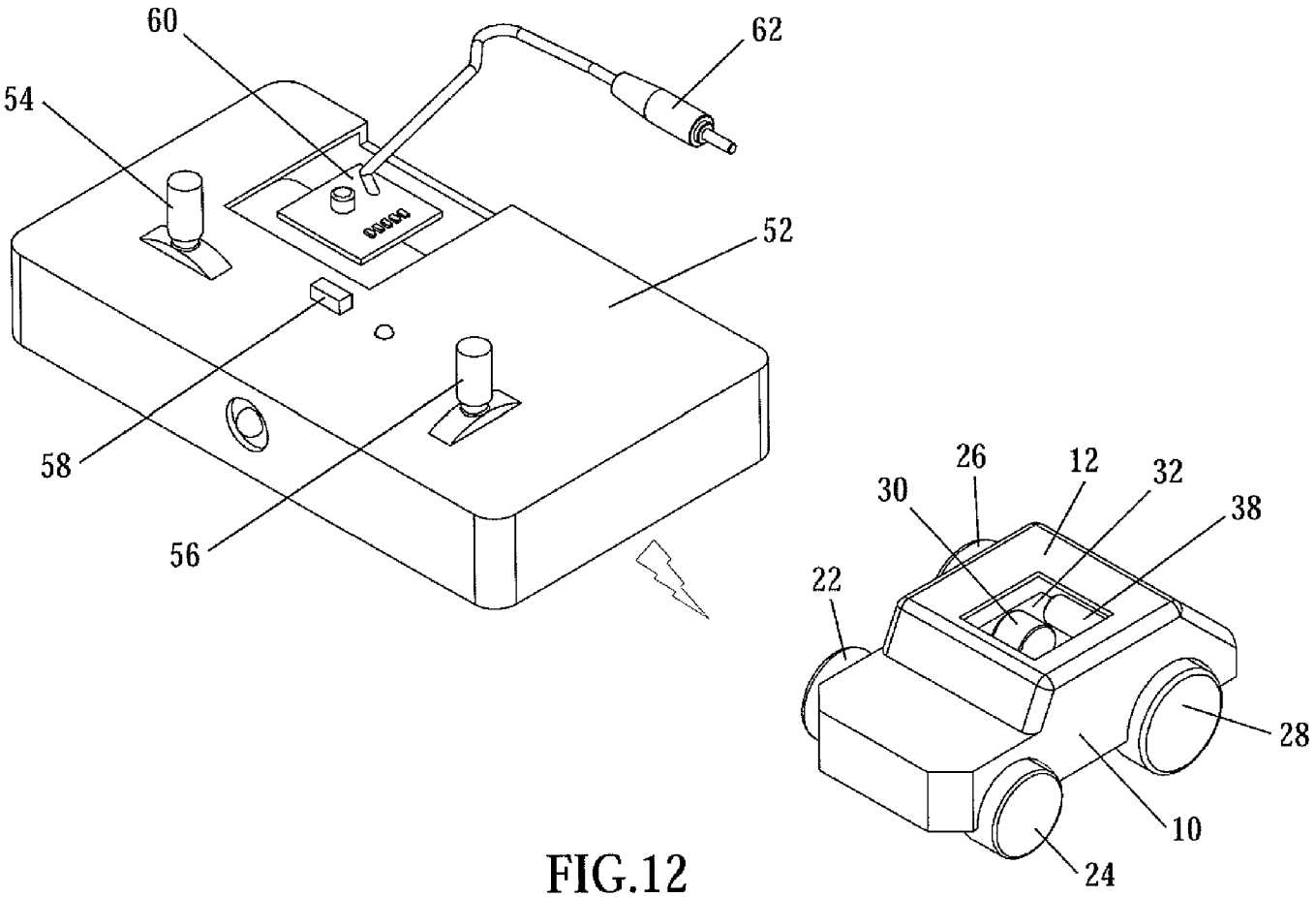
FIG. 12 is an isometric view of the remote control device and the vehicle.

1. An alternative design of the fork is a ball joint 134. (FIG. 6)
2. An alternative orientation of coil 100 magnet 104 and lever system 110, such as vertical alignment of coil, is also possible by having a different slide plate design 136. with right angular rod 138 for engaging the fork 114 of the lever 110. (FIG. 7)
3. The slide plate can be mounted in front of (FIGS. 8*a* and 8*b*) or behind (FIGS. 9*a* and 9*b*) the front wheel axle or axis 140.
4. There can be a front wheel suspension system design. There is a hinge 142 located on the frame 144 so that the frame 144 can be movable and pivoted along the longitudinal axis 120 of the car. (FIG. 10)
5. The disclosed steering system can be applied in either a remote control or a simple battery operated vehicle.

A toy car comprises with a car body, chassis, power source with at least one battery, electronic circuit board for steering control and a motor for speed control. There is remote controller to send a signal which is received from the remote control transmitter. There is at least one electric motor for driving the rear wheels. A magnetic coil activator acts with at least one of the front wheels for steering control. A gear box is associated with at least one rear wheel and the electric motor for power transmission.

The vehicle which can be a car can be further designed so that it can run in a track system.

An electric steering magnetic coil actuator is drivingly coupled with at least one front wheel. There is at least one front wheel coupled with the front portion and located on the vehicle so as to at least partially support the front portion. An electrically operated steering actuator is mounted for drivingly coupling at least one wheel to rotate at least one wheel to steer the toy vehicle.

A toy vehicle comprising a movable vehicle and a remote control device has controls for a user to regulate the movement of the vehicle.

The car preferably includes a pair of front wheels spaced apart to either side of the vehicle body, and a preferably a pair of rear wheels spaced apart to either side of the vehicle body.

There is a remote control device for communicating with a transceiver located with the vehicle. The remote control device includes one or more control levers also for regulating the rotation of the driven wheel. As such the vehicle can be controlled on the one hand by the microcontroller to automatically control the speed of rotation and steering to the wheels.

The toy is a combination with a remote control device configured to selectively control movement and steering of the toy vehicle and activation of the rotational drive mechanism.

The remote control device comprises a handheld remote controller having a multi-part housing, and wherein at least two of the housing parts are pivotable with respect to each other in order to control an operation of the toy vehicle.

The toy car 10 comprises a body 12. There is the following:

(1) A car housing and chassis 102.
(2) A steering mechanism for steering the front wheels.
(3) Front wheels 22, 24 and rear wheels 26 and 28.
(4) Battery power source 30 such as LiPO, LiFePO4 or Li-ion.
(5) PCBA 32 for electronic microcontroller system control and signal receiver or transceiver.
(6) A driving mechanism associated with a powerful dc cureless motor 38 and gearbox(es) driving the rear wheels 26 and 28.

There is a remote controller 52 which is remotely located relative to the car 10 and is used by the user to control speed and direction and turning with different toggle controls 54, 56 and 58 on the face of the controller. There can be a charger unit 60 associated with the controller 52, and the charger is connectable through a cable 62 for recharging the battery 30. In an alternative way, the charger unit 60 can be located inside the car 10, and the primary battery 30 is connected to the charger unit 60.

The front wheels each include a wheel hub and a tire. The hub is attached to a support arm. The support arms can include a top support pin and a bottom support pin. The support arms further include a steering pivot pin.

The steering assembly is coupled to the wheel assemblies to provide powered steering control. The steering assembly can include a steering actuating lever can extend from the magnet and moves from left to right. The steering actuating lever can fit within a receptacle in a tie rod. The tie rod is provided with holes at each opposing end. The steering pivot pins fit within the holes. As the tie rod moves left and right under the action of the steering actuating lever the front wheel assemblies are caused to turn as support arms are pivoted by steering pivot pins. The position of the tie rod can be adjustable by a steering trim mechanism. One of ordinary skill will appreciate that any know steering assembly can be used with the present disclosure to provide steering control of the toy vehicle 10.

The body 12 can be ornamented cover assemblies. The housing and chassis 102 mounts a drive motor for one or more rear wheel assemblies mounted to an axle, and mounted for rotation relative to the housing and chassis 102. The housing and chassis 102 can include drive shaft support members.

A circuit board 32 contains the device electronics is supported by a mounting with the chassis and housing 102. The circuit board 32 is electrically connected with the coil 100 and rear drive motor. An on/off switch is accessible from the underside of the housing and chassis 102.

The drive assembly can include one or two drive motors. The drive motors can be reversible electric motors of the type generally used in toy vehicles. The motors are operably coupled to the axle through a drive gear train. The drive gear train includes a pinion affixed to an output shaft of the drive motors. The motors 38 can drive the rear wheel assemblies through the drive gear train in either a forward or reverse direction. Other drive train arrangements could be used such as belts or other forms of power transmission. The arrangements disclosed herein are not meant to be limiting.

In operation, a user drives the toy vehicle 10 so that the vehicle can continue driving in the selected forward or reverse direction. The microcontroller on board is signaled by the voltage sensor and it acts to change the speed of rotation of the wheels when the vehicle as desired and controlled or impart a higher than normal speed under appropriate conditions.

The vehicle 10 can be constructed of, for example, plastic or any other suitable material such as metal or composite materials. From this disclosure, it would be obvious to one skilled in the art to vary the dimensions of the toy vehicle 10 shown, for example making components of the toy vehicle smaller or larger relative to the other components.

The toy vehicle 10 is preferably controlled via wireless signals such as Infrared or radio signal from a remote controller. However, other types of controllers may be used including wired controllers, voice-activated controllers, and the like.

A preferred embodiment of a remote controller for use with the present disclosure preferably comprises a multi-part housing having left hand and right hand toggles. Each of the left hand and right hand toggles are on a top housing. An antenna may be included to receive and/or transmit signals to and/or from the remote controller.

The remote controller also preferably includes circuitry to, for example, process inputs from the switch, the left and right toggles, switches, and to transmit and receive signals to and from the toy vehicle 10.

It will be understood that the remote controller can be formed of a variety materials and may be modified to include additional switches and/or buttons. It will be further understood that a variety of other types of controllers may be used to control the operation of the toy vehicle of the present disclosure.

One of ordinary skill will appreciate that although the embodiments discussed above refer to a single orientation sensor, there could be more than one sensor with the toy vehicle 10 and other modes of operation could be used.

It will be appreciated by those skilled in the art that changes could be made to the embodiments described above without departing from the broad inventive concept thereof. It is understood, therefore, that this disclosure is not limited to the particular embodiments disclosed, but it is intended to cover modifications within the spirit and scope of the present disclosure.

Many of the features of the present disclosure are implemented by suitable algorithms that are executed by one or more the microcontrollers with the vehicle and/or remote controller. For example, all voltages and, currents at critical circuit points, and velocity are monitored by the software routines.

Although the present disclosure has been described with respect to particular embodiments thereof, variations are possible. Although the disclosure is described of a four-wheeled embodiment, the present disclosure there could also comprise a vehicle having three wheels, or more than four wheels or a track drive system. There may be a motorcycle format with two wheels, or a system with 3 wheels, for instance two in the rear and one in the front.

The present disclosure has advantages over systems using an electromagnetic coil wound around the wheel shaft or having opposing poles of a permanent magnet and a solenoid coil positioned equidistant between the poles, which involve multiple permanent magnets to deflect the energized solenoid coil from one end to the other end.

In the present disclosure, the mechanism in one form uses a single permanent magnet and a single coil system. In this case the coil is mounted on a fixed position, which can be the chassis or some other convenient part of the body. In some cases instead of placing the magnet inside the coil it may be located in a position sufficiently close to be effected sufficiently by the electromagnet to generate the steering action. Here, the magnetic strength of coil is not as strong as permanent magnet, and additional wires on a moving part would be necessary.

The present disclosure may be embodied in specific forms without departing from the essential spirit or attributes thereof. In particular, although the disclosure is illustrated using a particularly format with particular component values, one skilled in the art will recognize that various values and schematics will fall within the scope of the disclosure. It is desired that the embodiments described herein be considered in all respects illustrative and not restrictive and that reference be made to the appended claims and their equivalents for determining the scope of the disclosure.

The invention claimed is:

1. A movable toy vehicle comprising a vehicle body, chassis, a front wheel and a rear wheel, a power source with at least one battery, a magnetic coil activator and a magnet for wheel steering control, a circuit for applying a current to the coil thereby to move the magnet, and wherein movement of the magnet is transmitted to a steering shaft thereby permitting steering the vehicle, a mounting for the coil on the vehicle chassis, a permanent magnet attached to one end of a lever, and wherein the magnet is located inside the coil and pivotable transversely on the coil axis so the when the coil is energized by electric current, the magnetic field generated from the coil deflects the permanent magnet and the lever to one side, providing the other end of the lever as a fork, and including a rod for engagement with the fork.

2. A toy as claimed in claim 1, wherein the magnet is a permanent magnet, and including a mounting to pivot the permanent magnet in relation to the coil, and wherein the coil is powered by the battery.

3. A toy as claimed in claim 1, including a electronic circuit board for control of current to the coil, and a receiver with the vehicle for receiving a signal from a transmitter with the remote controller, the remote control having controls for a user to regulate the steering of the vehicle.

4. A toy as claimed in claim 1 including at least one drive electric motor for driving a wheel of the vehicle, a receiver with the vehicle for receiving a signal from a transmitter with a remote controller, a control of the drive electric motor, the receiver being for receiving remote signal from the transmitter, the remote controller having controls for a user to regulate the movement of the vehicle.

5. A toy as claimed in claim 1 including having the rod connect with a slide plate, the plate being slidable relative to a frame wherein when the lever is deflected by electromagnetic force, a plane movement of the slide plate is effected transversely of a longitudinal axis of the vehicle.

6. A toy as claimed in claim 5 wherein each respective end of the slide plate is connected to a mechanical linkage respectively of a left front wheel and a right front wheel for the vehicle.

7. A toy as claimed in claim 6 wherein when the slide plate performs a linear plane movement, the linear motion is transformed to a turning effect of front wheels of a vehicle.

8. A toy as claimed in claim 6 including a spring, the spring being for urging the return the slide plate and the lever to a neutral position, the neutral position being when the coil is dis-energized.

9. A toy as claimed in claim 1 including mounting the coil relative to the chassis whereby the orientation of coil, and magnet is such that there is a vertical alignment of the coil.

10. A toy as claimed in claim 1 including mounting the coil relative to the chassis whereby the orientation of coil, and magnet is such that there is a horizontal alignment of the coil.

11. A toy as claimed in claim 1 including a hinge relative to the chassis, a pair of front wheels, whereby the chassis and an axle between the front wheels are relatively movable and pivotable around a longitudinal axis of the vehicle.

12. A movable toy vehicle comprising a vehicle body, chassis, a front wheel and a rear wheel, a power source with at least one battery, a magnetic coil activator and a magnet for wheel steering control, a circuit for applying a current to the coil thereby to move the magnet, and wherein movement of the magnet is transmitted to a steering shaft thereby permitting steering the vehicle, a mounting for the coil on the vehicle chassis, a permanent magnet attached to one end of a lever, and wherien the magnet is located inside the coil and pivotable transversely on the coil axis so the when the coil is energized by electric current, the magnetic field generated from the coil deflects the permanent magnet and the lever to one side, a ball joint on the other end of the lever, and including a rod for engagement with the ball joint.

13. A movable toy vehicle comprising a vehicle body, chassis, a front wheel and a rear wheel, a power source with at least one battery, a magnetic coil activator and a magnet for wheel steering control, a circuit for applying a current to the coil thereby to move the magnet, and wherein movement of the magnet is transmitted to a steering shaft thereby permitting steering the vehicle, a pair of slide plate for performing a linear plane motion, and wherein the linear motion is transformed to a turning effect of front wheels of a vehicle, and wherein a first slide plate is mounted in front of a wheel axis and a second slide plate is mounted behind the wheel axis.

14. A movable toy vehicle and a remote control device having controls for a user to regulate the movement of the vehicle, the vehicle including a body, a chassis, a front wheel and a rear wheel, a power source with at least one battery, at least one drive electric motor for driving one of the wheels of the vehicle, an electronic circuit for controlling operation of the motor, a receiver with the vehicle for receiving a signal from a transmitter with the remote controller, a magnetic coil activator and a magnet for wheel steering control, a circuit for applying a current to the coil thereby to move the magnet, and wherein movement of the magnet is transmitted to a steering shaft thereby to effect turning of a wheel and for permitting steering the vehicle, a mounting for the coil on the vehicle chassis, a magnet attached to one end of a lever, and wherein the magnet is located inside the coil and pivotable transversely on the oil axis so the when the coil is energized by electric current, the magnetic field generated from the coil deflects the magnet and the lever to one side, providing the other end of the lever as a fork, and including a rod for engagement with the fork.

15. A movable toy vehicle and a remote control device having controls for a user to regulate the movement of the vehicle, the vehicle including a body, a chassis, a front wheel and a rear wheel, a power source with at least one battery, at least one drive electric motor for driving one of the wheels of the vehicle, an electronic circuit for controlling operation of the motor, a receiver with the vehicle for receiving a signal from a transmitter with the remote controller, a magnetic coil activator and a magnet for wheel steering control, a circuit for applying a current to the coil thereby to move the magnet, and wherein movement of the magnet is transmitted to a steering shaft thereby to effect turning of a wheel and for permitting steering the vehicle, a mounting for the coil on the vehicle chassis, a magnet attached to one end of a lever, and wherein the magnet is located inside the coil and pivotable transversely on the coil axis so the when the coil is energized by electric current, the magnetic field generated from the coil deflects the magnet and the lever to one side, and a ball joint on the other end of the lever, and including a rod for engagement with the ball joint.

16. A movable toy vehicle comprising a vehicle body, chassis, a front wheel and a rear wheel, a power source with at least one battery, a magnetic coil activator and a magnet for wheel steering control, a circuit for applying a current to the coil thereby to move the magnet, and wherein movement of the magnet is transmitted to a steering shaft thereby permitting steering the vehicle, a mounting for the coil on the vehicle chassis, a permanent magnet attached towards one end of a lever, and wherein the magnet is pivotable transversely on the coil axis so the when the coil is energized by electric current, the magnetic field generated from the coil deflects the permanent magnet and the lever to one side, the coil defining a transverse perimeter, the perimeter defining a transverse area, and the coil having a height and having a space within the perimeter area and accommodating the magnet in the space, an engaging element for engagement with the lever towards an end of the lever remote from the end attached to the magnet, the engaging element and lever connecting end being outside the height of the coil and being within the transverse area defined by the coil perimeter.

17. The toy as claimed in claim 16 wherein the engaging element and lever include a rod and a fork configuration formed between the magnet and the slide plate.

18. The toy as claimed in claim 16 wherein the engaging element is a rod, a slide plate affixed to the rod, and movement of the rod effects movement of the slide plate, the rod and slide plate movement being solely parallel to the transverse area defined by the coil.

19. A movable toy vehicle comprising a vehicle body, chassis, a front wheel and a rear wheel, a power source with at least one battery, a magnetic coil activator and a magnet for wheel steering control, a circuit for applying a current to the coil thereby to move the magnet, and wherein movement of the magnet is transmitted to a steering shaft thereby permitting steering the vehicle, a mounting for the coil on the vehicle chassis, a permanent magnet attached towards one end of a lever, and wherein the magnet is pivotable transversely on the coil axis so the when the coil is energized by electric current, the magnetic field generated from the coil deflects the permanent magnet and the lever to one side, the coil defining a transverse perimeter, the perimeter defining a transverse area, and the coil having a height and having a space within the perimeter area and accommodating the magnet in the space, an engaging element for engagement with the lever towards an end of the lever remote from the end attached to the magnet, the engaging element and lever connecting end being outside the height of the coil and being within the transverse area defined by the coil perimeter, a slide plate affixed to the engaging element, and movement of the engaging element effects movement of the slide plate, the engaging element and slide plate movement being solely parallel to the transverse area defined by the coil, and the plate being mounted in a position at least partly above the perimeter area of the coil.

20. The toy as claimed in claim 19 wherein the engaging element and lever include a rod and a fork configuration formed between the magnet and the slide plate.

21. The toy as claimed in claim 19 wherein the engaging element is a rod, a slide plate affixed to the rod, and movement of the rod effects movement of the slide plate, the rod and slide plate movement being solely parallel to the transverse area defined by the coil.

22. A movable toy vehicle comprising a vehicle body, chassis, a front wheel and a rear wheel, a power source with at least one battery, a magnetic coil activator and a magnet for wheel steering control, a circuit for applying a current to the coil thereby to move the magnet, and wherein movement of the magnet is transmitted to a steering shaft thereby permitting steering the vehicle, a mounting for the coil on the vehicle chassis, a permanent magnet attached towards one end of a lever, and wherein the magnet is pivotable transversely on the coil axis so the when the coil is energized by electric current, the magnetic field generated from the coil deflects the permanent magnet and the lever to one side, the coil defining a transverse perimeter, the perimeter defining a transverse area, and the coil having a height and having a space within the perimeter area and accommodating the magnet in the space, an engaging element for engagement with the lever towards an end of the lever remote from the end attached to the magnet, the engaging element and lever connecting end being outside the height of the coil and being within the transverse area defined by the coil perimeter, a slide plate affixed to the engaging element, and movement of the engaging element effects movement of the slide plate, the engaging element and slide plate movement being parallel and linear to the transverse area defined by the coil, a hinge relative to a chassis, whereby the chassis is relatively pivotable about the hinge around the longitudinal axis of the vehicle and effectively the plate is also relatively pivotable in relation to the hinge around the longitudinal axis of the vehicle.

* * * * *